US006874712B2

(12) United States Patent
Milojevic et al.

(10) Patent No.: US 6,874,712 B2
(45) Date of Patent: Apr. 5, 2005

(54) SWIRL GUN FOR POWDER PARTICLES

(75) Inventors: Dragoslav K. Milojevic, Bloomfield Hills, MI (US); Christopher M. Rennie, Waterford, MI (US); Melissa L. Koster, New Hudson, MI (US); Gary J. Ciarelli, Milford, MI (US); Gunter Börner, Sinsheim (DE)

(73) Assignee: ABB Inc., New Berlin, WI (US)

( * ) Notice: Subject to any disclaimer, the term of this patent is extended or adjusted under 35 U.S.C. 154(b) by 60 days.

(21) Appl. No.: 10/259,209

(22) Filed: Sep. 27, 2002

(65) Prior Publication Data

US 2004/0061007 A1 Apr. 1, 2004

(51) Int. Cl.[7] ..... B05B 5/00
(52) U.S. Cl. ..... 239/690; 239/690.1; 118/629
(58) Field of Search ..... 239/690, 690.1, 239/692, 704, 705, 706, 707; 118/620, 627, 629, 621; 427/458, 561, 562, 444

(56) References Cited

U.S. PATENT DOCUMENTS 4,110,486 A * 8/1978 Lacchia ..... 427/475
4,808,432 A * 2/1989 Hajek ..... 427/472
5,351,903 A * 10/1994 Mazakas et al. ..... 239/705
5,353,995 A 10/1994 Chabert ..... 239/701
5,400,976 A * 3/1995 Kaijyu et al. ..... 239/692
5,711,489 A 1/1998 Yanagida et al. ..... 239/697
5,997,643 A * 12/1999 Wilson et al. ..... 118/308
6,053,420 A 4/2000 Ahlbert et al. ..... 239/3
6,254,684 B1 7/2001 Borner et al. ..... 118/629
6,645,300 B2 * 11/2003 Rehman et al. ..... 118/629

FOREIGN PATENT DOCUMENTS

DE 19614193 A 10/1997

* cited by examiner

*Primary Examiner*—David A. Scherbel
*Assistant Examiner*—Thach H. Bui
(74) *Attorney, Agent, or Firm*—Harness, Dickey & Pierce, P.L.C.

(57) ABSTRACT

A powder spraying gun generates a desired pattern of electrostatically charged particles for coating a workpiece without rotating parts or particle deflectors. The powder pattern is generated with a funnel-shaped output in conjunction with air introduced into a powder charging chamber of the gun in a tangential swirling motion. The swirling air is additionally used to purge agglomerated powder particles from the charging electrodes in the charging chamber. The charging chamber surface is fashioned from material exhibiting low friction or high resistance to powder impact fusion.

19 Claims, 3 Drawing Sheets

SWIRL GUN FOR POWDER PARTICLES

BACKGROUND OF THE INVENTION

The invention relates generally to spray guns for charging and distributing powders, such as electrostatically-charged powder paint particles, for deposition on the surface of a workpiece.

Conventional powder applicators are based on exterior electrostatic charging of a dispersed particle cloud as partly described in U.S. Pat. No. 5,711,489. This patent also describes means for improving the particle dispersion by a rotating airstream in the interior of the gun, as well as temperature and humidity control of the powder feeding airstream. Other conventional powder applicators are based on rotating bell cup principles such as described in U.S. Pat. No. 5,353,995.

U.S. Pat. No. 6,254,684 describes an internally charged powder spraying applicator wherein the powder is pre-charged in the interior charging chamber of the gun. The process of interior charging requires interior high voltage electrodes and at least one ground electrode. The '684 patent discloses a first design in which a round powder cloud pattern is produced by means of a round conical deflector and a second approach wherein a flat spray pattern is generated by means of a slotted nozzle. Generation of a rounded powder cloud is important in cases where a robot or some other reciprocating machine is used to move an applicator around or inside of the painted workpiece object. The cloud generator in the '684 patent has some disadvantages regarding contamination of the deflector by paint particles which leads to coating defects on the workpiece due to dripping of powder agglomerates on the surface of the workpiece. Generation of a flat spray pattern is less subject to contamination and is more widely used for flat workpiece surfaces. However, a flat pattern is more difficult to use for curved workpiece surfaces and for robotic applications, in that this design approach requires more robot arm reorientations when programming robot strokes for effecting desired surface covering.

U.S. Pat. No. 6,053,420 discloses a conical powder dispersing unit based on a tangential air/powder mixture flow which provides a round powder cloud spray pattern, yet avoids use of a deflector in the direction of the powder flow. While this approach provided an improvement to U.S. Pat. No. 5,711,489, it has nevertheless been limited to cone sizes of 50 to 170 mm. diameter which is rather large for robotic applications. Additionally, at this size, the powder cloud becomes rather "soft" in order to be moved by a robot arm. The approach disclosed in the '420 patent additionally anticipated a direct feeding from a fluidized powder bed feeder in a dense powder flow directly through a relatively small orifice.

German Published Patent Application No. 19614193 describes the combination of interior or exterior powder charging combined with exterior tangential swirl flow which is intended to produce a softer rotating round pattern powder cloud while avoiding use of deflectors in the powder stream.

There is seen, therefore, to be a need in the art for a powder applicator with the capability for utilizing shaping air rather than deflectors, yet have the capability to maintain the powder/air mixture in a more intense motion.

SUMMARY OF THE INVENTION

Accordingly, in one aspect of the invention, a powder spraying gun for electrostatic powder coating application includes a gun body having an interior powder charging chamber defining a surface extending along an axis of the gun body and fashioned from a material exhibiting resistance to powder impact fusion. A powder supply input in fluid communication with the powder charging chamber at a first end thereof and extending at an angle to the axis of the gun different from 90° supplies the powder particles to the charging chamber. An output chamber having a funnel-shaped output is in fluid communication with the powder charging chamber at a second end thereof. A ground electrode extends into the first end of the powder charging chamber and a plurality of interior charging electrodes radially extend into the powder charging chamber upstream of the output chamber.

In another aspect of the invention, a powder spraying gun for electrostatic powder coating application includes a gun body having an interior powder charging chamber defining a surface extending along an axis of the gun body. A powder supply input in fluid communication with the powder charging chamber at a first end thereof and extending at an angle to the axis of the gun different from 90° supplies the powder particles to the charging chamber. An output chamber having a funnel-shaped output is in fluid communication with the powder charging chamber at a second end thereof. A ground electrode extends into the first end of the powder charging chamber and a plurality of interior charging electrodes radially extend into the powder charging chamber upstream of the output chamber. A compressed air inlet is adapted for coupling a source of compressed air to a plurality of air conduits each tangentially opening at the surface of the powder charging chamber between pairs of the plurality of interior charging electrodes and for introducing air in a swirling pattern into the charging chamber for imparting a swirling motion to powder particles and for purging powder particles adhering to exposed surfaces of the interior charging electrodes.

In yet another aspect of the invention, a powder spraying gun for electrostatic powder coating application includes a gun body having an interior powder charging chamber defining a surface extending along an axis of the gun body and fashioned from a material exhibiting resistance to powder impact fusion. A powder supply input in fluid communication with the powder charging chamber at a first end thereof and extending at an angle to the axis of the gun different from 90° supplies the powder particles to the charging chamber. An output chamber having a funnel-shaped output is in fluid communication with the powder charging chamber at a second end thereof. A ground electrode extends into the first end of the powder charging chamber. A plurality of exterior charging electrodes extend through the funnel-shaped output. A compressed air inlet is adapted for coupling a source of compressed air to a plurality of air conduits each tangentially opening at the surface of the powder charging chamber for introducing air in a swirling pattern into the charging chamber for imparting a swirling motion to powder particles.

BRIEF DESCRIPTION OF THE DRAWING

The objects and features of the invention will become apparent from a reading of a detailed description, taken in conjunction with the drawing, in which.

DETAILED DESCRIPTION

With the arrangement to be described below, a powder paint applicator will use internal pre-charging of the powder in a chamber having a diameter substantially reduced over that of the prior art in order to maintain the powder/air mixture in a more intense motion.

Figure 1:
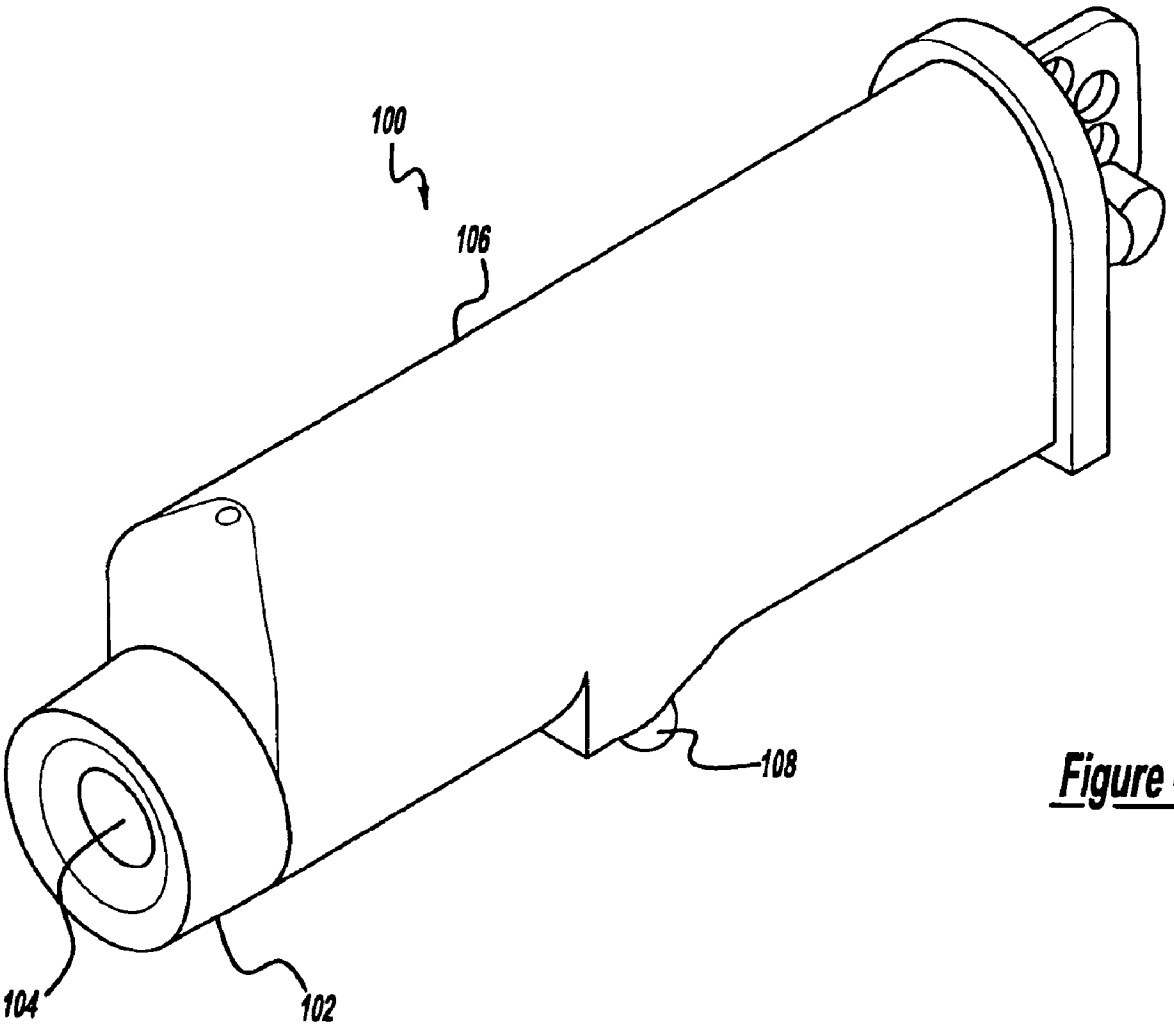
FIG. 1 is a perspective view of a powder spray gun arranged in accordance with the principles of the invention.
Figure 2:
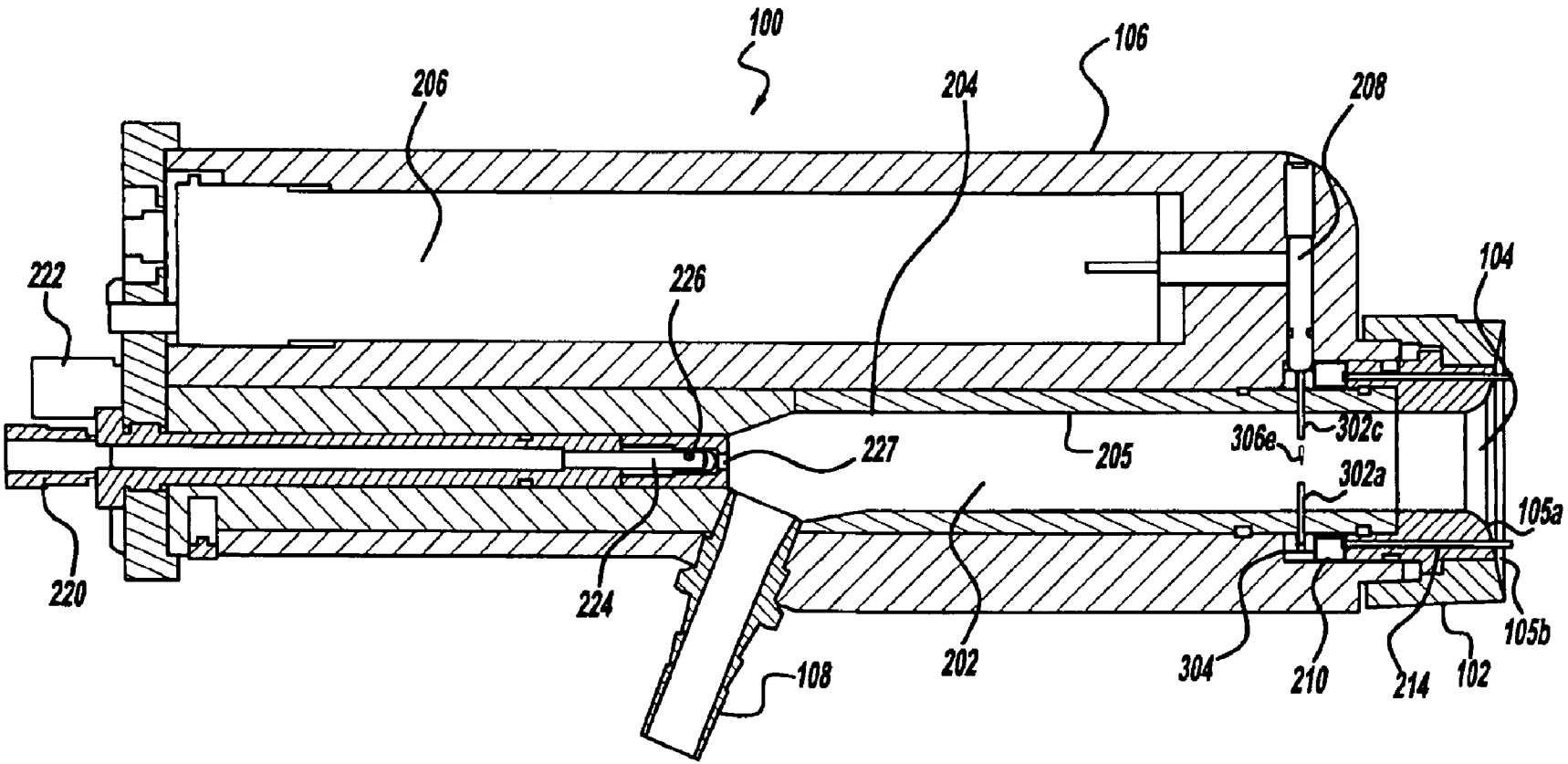
FIG. 2 is a longitudinal cross-sectional view of FIG. 1.
Figure 3:
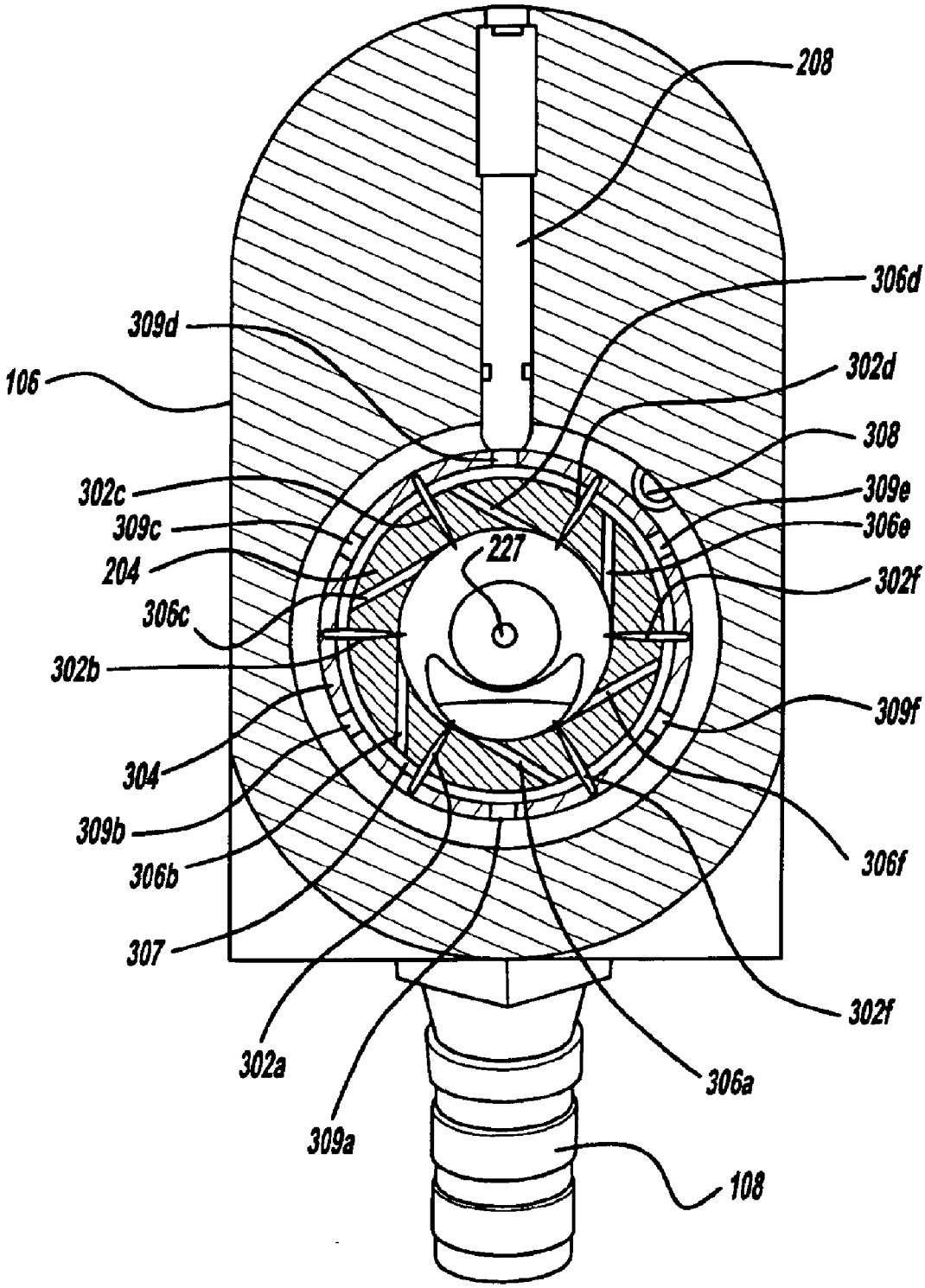
FIG. 3 is a radial cross-sectional view of the spray gun of FIG. 2 taken in the vicinity of the interior charging electrodes of the gun.

With reference to FIGS. 1–3, a powder spraying gun 100 for electrostatic powder coating application has an elongate gun body 106 extending along a longitudinal axis towards an output chamber comprised of a swirl bell cup 104 held in a cup retainer 102. A powder/air feed mixture from a powder supply enters the gun body at inlet 108.

As seen more clearly from FIG. 2, gun 100 has its applicator housing 106 enclosing both a high voltage cascade 206 and a powder charging chamber 202 which provides a chamber surface 205 defined principally by a removable insert 204 fashioned from a low friction material which is resistant to powder impact fusion. Examples of such a suitable material are commercially available plastics.

A first inlet end of powder charging chamber 202 is in fluid communication with powder/air mixture supply conduit 108. Input 108 has a longitudinal axis which intersects the longitudinal axis of chamber 202 at an angle other than 90°, preferably at an angle on the order of 75°.

The inlet end of chamber 202 is also in fluid communication, via an aperture 227, with a ground electrode 224 which extends substantially along the longitudinal axis of chamber 202 from a first end of gun body 106 at a ground electrode purge air inlet 220 to an electrode tip adjacent aperture 227. Electrode 224 comprises a hollow tube-type arrangement which enables introduction of purge air at inlet 220 to flow along the interior of the tube portion of the electrode 224 to at least one purge air aperture 226 located in the cylindrical surface of the electrode and exiting the aperture so as to purge powder particles adhering to the head of electrode 224. Purge air entering the charging chamber 202 at aperture 227 assists in propelling powder particles entering at input 108 along the axis of the chamber 202.

Additionally located at the first end of gun body or housing 106 is a swirl air inlet 222 adapted to be coupled to a source of compressed air for direction into the gun body to a point around the circumference of the charging chamber 202 in the vicinity of interior charging electrodes 302*a–f* (FIG. 3). This compressed air conduit extending from air inlet 222 of FIG. 2 is shown in FIG. 3 as 308. From 308, the air is directed through a gap between insert 204 and the gun body through a plurality of air slots 309*a–f* formed in electrode mounting ring 304, which is fashioned from electrically conductive plastic. Air slots 309*a–f* direct the compressed air into a groove 307 formed on the interior surface of ring 304. Groove 307, in turn, causes the air to enter air conduits 306*a–f* which causes the air to be tangentially directed into charging chamber 202. The plurality of tangential conduits is equal in number to the plurality of interior needle charging electrodes 302*a–f*. In the example shown in FIG. 3, there are six needle electrodes and six tangential air conduits.

The interior needle electrodes 302 radially enter chamber 202 via conductive plastic mounting ring 304.

An important feature of air conduits 306*a–f* is the simultaneous dual function of same to (a) impart the desired swirling motion to the powder particles as they enter swirl bell cup 104 and (b) provide a purging air source for cleaning the portions of the needle electrodes 302 exposed to the interior of charging chamber 202.

Conductive plastic ring 304 is coupled via a high voltage conductor 208 to the high voltage cascade (or DC-to-DC voltage converter) 206 which is adapted to be coupled to a source of potential at the first end of body 106, as best shown in FIG. 2.

Swirl bell cup or output chamber 104, in conjunction with cup retainer 102 provides an output frusto-conical wall which forms a funnel-shaped outlet forming an angle of preferably on the order of about 120° to about 180°. The funnel-shaped outlet has a diameter preferably in the range of about 25 mm. to about 70 mm.

The funnel-shaped output wall is formed by a radially inward portion 105*a* contributed by the swirl cup 102 and by a radially outward portion 105*b* provided by cup retainer 102. Hence, by switching between various sized and/or angled cup retainers, the overall dimension and/or shape of the funnel-shaped output can be varied to generate a variety of powder patterns at the gun output.

Charging chamber 202 has a longitudinal length preferably on the order of about 70 to about 150 mm., while the diameter of chamber 202 lies between about 13 mm. and 20 mm., with a preferred diametrical range of on the order of 15 mm. to 17 mm.

In addition to or, optionally in place of, the interior charging electrodes 302*a–f*, a plurality of exterior charging needle electrodes 214 extend from a conductive plastic ring 210 surrounding chamber 202 and then through the swirl bell cup 104 to a point exterior of the funnel-shaped outlet. This arrangement is best shown in FIG. 2. The exterior charging electrodes 214 provide for electrostatic field control of the emerging powder cloud relative to a workpiece to be coated.

In operation, a powder/air mixture enters charging chamber 202 via inlet 108, wherein via ground electrode 224 and charging electrode needles 302, the powder is electrostatically charged while simultaneously set in motion in a swirl-type pattern due to the injected air via tangential ducts 306. Powder movement is also assisted in a longitudinal direction by the compressed air entering ground electrode purge air inlet 220 and exiting at hole(s) 226 at the head of ground electrode 224 in the vicinity of input 108. As the powder moves toward the outlet end of the gun chamber, the swirling air effects a desired spray pattern which is defined by controlling the ratio of the longitudinal air flow with that of the swirl pattern. The invention further contemplates varying the tangential component of air flow for generating different shapes of spray patterns and different residence times of the powder particles, thus improving charging efficiency of the resultant cloud, the width of the spray pattern and the powder transfer efficiency.

With the gun arrangement as shown and described above, more uniform electrostatic coating is effected due to improved powder dispersion. Additionally, more efficient continuous cleaning of the interior charging electrodes via the tangential air entry ports improves the efficiency of the internal charging of the powder coating material.

The invention has been described with respect to an exemplary embodiment and the details of same are to be taken for the sake of example only. The scope and spirit of the invention are as set forth in appropriately interpreted claims.

What is claimed is:

1. A powder spraying gun for electrostatic powder coating application comprising:

a gun body having an interior powder charging chamber defining a surface extending along an axis of the gun body and fashioned from a material exhibiting resistance to powder impact fusion;

a powder supply input in fluid communication with the powder charging chamber at a first end thereof and extending at an angle to the axis different from 90°;

an output chamber having a funnel-shaped output in fluid communication with the powder charging chamber at a second end thereof;

a ground electrode extending into the first end of the powder charging chamber;

a plurality of interior charging electrodes radially extending into the powder charging chamber; and a plurality of exterior charging electrodes extending through the funnel-shaped output and positioned so as to be capable of creating an external electrostatic field between the gun output and a workpiece to be coated.

2. A powder spraying gun for electrostatic powder application comprising:

a gun body having an interior powder charging chamber defining a surface extending along an axis of the gun body and fashioned from a material exhibiting resistance to powder impact fusion;

a powder supply input in fluid communication with the powder charging chamber at a first end thereof and extending at an angle to the axis different from 90°;

an output chamber having a funnel-shaped output in fluid communication with the powder charging chamber at a second end thereof;

a ground electrode extending into the first end of the powder charging chamber;

a plurality of interior charging electrodes radially extending into the powder charging chamber;

a compressed air inlet adapted for coupling to a source of compressed air;

a plurality of air conduits each tangentially opening at the surface of the powder charging chamber between pairs of the plurality of interior charging electrodes and in fluid communication with the compressed air inlet for introducing air in a swirling pattern into the charging chamber for imparting a swirling motion to powder particles and for purging powder particles adhering to exposed surfaces of the interior charging electrodes; and a plurality of exterior charging electrodes extending through the funnel-shaped output and positioned so as to be capable of creating an external electrostatic field between the gun output and a workpiece to be coated.

3. A powder spraying gun for electrostatic powder coating application comprising:

a gun body having an interior powder charging chamber defining a surface extending along an axis of the gun body and fashioned from a material exhibiting resistance to powder impact fusion;

a powder supply input in fluid communication with the powder charging chamber at a first end thereof and extending at an angle to the axis different from 90°;

an output chamber having a funnel-shaped output in fluid communication with the powder charging chamber at a second end thereof;

a ground electrode extending into the first end of the powder charging chamber;

a plurality of interior charging electrodes radially extending into the powder charging chamber; and wherein the funnel-shaped output has a funnel wall forming an angle between about 120° and about 180°.

4. A powder spraying gun for electrostatic powder coating application comprising:

a gun body having an interior powder charging chamber defining a surface extending along an axis of the gun body and fashioned from a material exhibiting resistance to powder impact fusion;

a powder supply input in fluid communication with the powder charging chamber at a first end thereof and extending at an angle to the axis different from 90°;

an output chamber having a funnel-shaped output in fluid communication with the powder charging chamber at a second end thereof;

a ground electrode extending into the first end of the powder charging chamber;

a plurality of interior charging electrodes radially extending into the powder charging chamber; and wherein the surfaces of the powder charging chamber is comprised of a removable insert of the material exhibiting resistance to powder impact fusion.

5. The powder spraying gun of claim 4 wherein the material exhibiting resistance to powder impact fusion comprises plastic.

6. A powder spraying gun for electrostatic powder coating application comprising:

a gun body having an interior powder charging chamber defining a surface extending along an axis of the gun body;

a powder supply input in fluid communication with the powder charging chamber at a first end thereof and extending at an angle to the axis different from 90°;

an output chamber having a funnel-shaped output in fluid communication with the powder charging chamber at a second end thereof;

a ground electrode extending into the first end of the powder charging chamber;

a plurality of interior charging electrodes radially extending into the powder charging chamber;

a compressed air inlet adapted for coupling to a source of compressed air;

a plurality of air conduits each tangentially opening at the surface of the powder charging chamber between pairs of the plurality of interior charging electrodes and in fluid communication with the compressed air inlet for introducing air in a swirling pattern into the charging chamber for imparting a swirling motion to powder particles and for purging powder particles adhering to exposed surfaces of the interior charging electrodes; and a plurality of exterior charging electrodes extending through the funnel-shaped output and positioned so as to be capable of creating an external electrostatic field between the gun output and a workpiece to be coated.

7. A powder spraying gun for electrostatic powder coating application comprising:

a gun body having an interior powder charging chamber defining a surface extending along an axis of the gun body;

a powder supply input in fluid communication with the powder charging chamber at a first end thereof and extending at an angle to the axis different from 90°;

an output chamber having a funnel-shaped output in fluid communication with the powder charging chamber at a second end thereof;

a ground electrode extending into the first end of the powder charging chamber;

a plurality of interior charging electrodes radially extending into the powder charging chamber;

a compressed air inlet adapted for coupling to a source of compressed air;

a plurality of air conduits each tangentially opening at the surface of the powder charging chamber between pairs of the plurality of interior charging electrodes and in fluid communication with the compressed air inlet for introducing air in a swirling pattern into the charging chamber for imparting a swirling motion to powder particles and for purging powder particles adhering to exposed surfaces of the interior charging electrodes; and wherein the funnel-shaped output has a funnel wall forming an angle between about 120° and about 180°.

8. A powder spraying gun for electrostatic powder coating application comprising:

a gun body having an interior powder charging chamber defining a surface extending along an axis of the gun body;

a powder supply input in fluid communication with the powder charging chamber at a first end thereof and extending at an angle to the axis different from 90°;

an output chamber having a funnel-shaped output in fluid communication with the powder charging chamber at a second end thereof;

a ground electrode extending into the first end of the powder charging chamber;

a plurality of interior charging electrodes radially extending into the powder charging chamber;

a compressed air inlet adapted for coupling to a source of compressed air; and a plurality of air conduits each tangentially opening at the surface of the powder charging chamber between pairs of the plurality of interior charging electrodes and in fluid communication with the compressed air inlet for introducing air in a swirling pattern into the charging chamber for imparting a swirling motion to powder particles and for purging powder particles adhering to exposed surfaces of the interior charging electrodes;

wherein the surface of the powder charging chamber is comprised of material exhibiting resistance to powder impact fusion; and wherein the surface of the powder charging chamber is defined by a removable insert of the material exhibiting resistance to powder impact fusion.

9. The powder spraying gun of claim 8 wherein the material exhibiting resistance to powder impact fusion comprises plastic.

10. A powder spraying gun for electrostatic powder coating application comprising:

a gun body having an interior powder charging chamber defining a surface extending along an axis of the gun body and fashioned from a material exhibiting resistance to powder impact fusion;

a powder supply input in fluid communication with the powder charging chamber at a first end thereof and extending at an angle to the axis different from 90°;

an output chamber having a funnel-shaped output in fluid communication with the powder charging chamber at a second end thereof;

a ground electrode extending into the first end of the powder charging chamber;

a plurality of exterior charging electrodes extending through the funnel-shaped output;

a compressed air inlet adapted for coupling to a source of compressed air; and a plurality of air conduits each tangentially opening at the surface of the powder charging chamber and in fluid communication with the compressed air inlet for introducing air in a swirling pattern into the charging chamber for imparting a swirling motion to powder particles.

11. The powder spraying gun of claim 10 further comprising a plurality of interior charging electrodes radially extending through the powder charging chamber and positioned between pairs of the plurality of air conduits.

12. The powder spraying gun of claim 10 wherein the funnel-shaped output has a funnel wall forming an angle between about 120° and about 180°.

13. The powder spraying gun of claim 10 wherein the surface of the powder charging chamber is defined by a removable insert of the material exhibiting resistance to powder impact fusion.

14. The powder spraying gun of claim 10 wherein the material exhibiting resistance to powder impact fusion comprises plastic.

15. The powder spraying gun of claim 13 wherein the material exhibiting resistance to powder impact fusion comprises plastic.

16. The powder spraying gun of claim 10 wherein the funnel-shaped output has an external diameter of about 25 mm. to about 70 mm.

17. The powder spraying gun of claim 10 wherein the powder charging chamber has a diameter of about 13 mm. to about 20 mm.

18. The powder spraying gun of claim 10 herein the powder charging chamber has a diameter of about 15 mm. to about 17 mm.

19. A powder spraying gun for electrostatic powder coating application comprising:

a gun body extending along a longitudinal axis thereof from a first end to a second end;

a substantially cylindrical powder charging chamber in the gun body having a removable insert defining a chamber surface, the insert fashioned from a material resistant to powder impact fusion, the chamber extending along the longitudinal axis toward the second end from a chamber input intermediate the first and second ends;

a powder supply input in fluid communication with the chamber input and extending at an angle to the longitudinal axis different from 90°;

a swirl bell cup having a funnel-shaped output in fluid communication with the powder charging chamber and coupled to the second end of the gun body;

a hollow tubular ground electrode having at least one orifice therein and extending from the first end of the gun body to an electrode head at the chamber input;

a ground electrode cleaning air input adapted for coupling a source of compressed air to the hollow tubular ground electrode and out of the at least one orifice so as to purge particles adhering to the electrode head;

a plurality of interior charging electrodes radially extending into the powder charging chamber via a first conductive plastic ring mounted around the insert downstream of the powder supply input;

a plurality of air conduits each tangentially opening at the surface of the insert between pairs of the plurality of interior charging electrodes;

a swirl air input at the first end of the gun body in fluid communication with the plurality of air conduits and adapted for coupling to a source of compressed air for imparting a swirling motion to powder particles in the vicinity of the tangential openings and for simultaneously purging powder particles adhering to the plurality of interior charging electrodes; and a plurality of exterior charging electrodes mounted to a second conductive plastic ring mounted to the insert adjacent the first conductive plastic ring and extending through the swirl bell cup and positioned so as to be capable of creating an external electrostatic field between the gun output and a workpiece to be coated.

* * * * *

UNITED STATES PATENT AND TRADEMARK OFFICE

CERTIFICATE OF CORRECTION

PATENT NO. : 6,874,712 B2
DATED : April 5, 2005
INVENTOR(S) : Dragoslav K. Milojevic et al.

It is certified that error appears in the above-identified patent and that said Letters Patent is hereby corrected as shown below:

Column 8,
Line 17, "herein" should be -- wherein --.

Signed and Sealed this

Fourteenth Day of June, 2005

JON W. DUDAS
*Director of the United States Patent and Trademark Office*